US009320350B1

(12) United States Patent
Fryshman

(10) Patent No.: US 9,320,350 B1
(45) Date of Patent: Apr. 26, 2016

(54) PORTABLE SURFACE EXTENDER

(76) Inventor: Bernard Fryshman, Brooklyn, NY (US)

( * ) Notice: Subject to any disclaimer, the term of this patent is extended or adjusted under 35 U.S.C. 154(b) by 0 days.

(21) Appl. No.: 13/166,710

(22) Filed: Jun. 22, 2011

(51) Int. Cl.
*A47B 1/04* (2006.01)
*A47B 5/02* (2006.01)
*A47B 1/00* (2006.01)

(52) U.S. Cl.
CPC .... *A47B 1/00* (2013.01); *A47B 5/02* (2013.01)

(58) Field of Classification Search
CPC ..... A47B 1/04; A47B 96/02; A47B 96/022; A47B 96/061; A47B 23/02; A47B 87/002; A47B 87/007
USPC ..... 108/42, 46, 152, 69, 73, 90, 64, 185; 248/229.14, 229.11, 229.26, 229.16, 248/229.12, 229.22, 231.61
See application file for complete search history.

(56) References Cited

U.S. PATENT DOCUMENTS 387,040 A * 7/1888 Blake ..... 108/69
937,639 A * 10/1909 Paulson ..... 108/69
1,108,692 A * 8/1914 Burd ..... 108/97
2,709,563 A * 5/1955 Starkey ..... 248/231.85
3,289,615 A * 12/1966 Marschak ..... 108/97
3,301,406 A * 1/1967 Scott ..... 108/97
3,741,131 A * 6/1973 Leadbetter ..... 108/97
3,894,496 A * 7/1975 Phillips et al. ..... 108/50.11
5,036,777 A * 8/1991 Barton ..... 108/90
5,312,002 A * 5/1994 DiCicco ..... 211/88.01
5,317,977 A * 6/1994 Omessi ..... 108/97
5,568,775 A * 10/1996 Rizzi et al. ..... 108/64
5,673,631 A * 10/1997 Guns et al. ..... 108/64
5,876,002 A * 3/1999 White et al. ..... 108/69
6,357,703 B1 * 3/2002 DiOrio ..... 108/69
6,910,429 B1 * 6/2005 Matay et al. ..... 108/44
7,003,827 B2 * 2/2006 DeMayo ..... 248/229.14
7,665,606 B2 * 2/2010 Gaillard ..... 206/363

* cited by examiner

*Primary Examiner* — Jose V Chen
(74) *Attorney, Agent, or Firm* — Amster, Rothstein & Ebenstein LLP

(57) ABSTRACT

A portable surface extender for temporarily extending the surface of a desktop or such similar surface. The extender is a slender panel having gripping members on at least on side. The gripping members attach to a desktop. Alternatively, a panel is attached to a desk by way of a conjoining adaptor, which has two opposing groups of gripping members. One group of members grips a desk or tabletop, whereas, an opposing group of members grips a panel or the like.

2 Claims, 7 Drawing Sheets

PORTABLE SURFACE EXTENDER

FIELD OF THE INVENTION

The current invention relates to the field of furniture accessories, more specifically to a novel method and apparatus for temporarily extending the surface of a desk or such similar surface.

BACKGROUND OF THE INVENTION

Students, among others, often need additional temporary desk space. Far too often one sees people taking an examination with test paper occupying an arm rest/desk, with a calculator balanced on a knee and coffee cup on the floor. Room size considerations usually prevent the purchase and permanent use of larger desks. There is, therefore, a need for a portable device that can be temporarily appended to the surface of desk in order to extend the surface thereof.

SUMMARY OF THE INVENTION

The invention set forth herein is directed to a novel portable extension surface, which is readily mounted to a desk surface and dismounted after use. The extension surface is selectively connected to an existing surface by any of a variety of mechanical gripping or tensioning means.

DETAILED DESCRIPTION OF THE INVENTION

Embodiments of the present invention will now be described with reference to the above-identified Drawings. However, the Drawings and the description herein of the invention are not intended to limit the scope of the invention. It will be understood that various modifications of the present description of the invention are possible without departing from the spirit of the invention. Also, features described herein may be omitted, additional features may be included, and/or features described herein may be combined in a manner different from the specific combinations recited herein, all without departing from the spirit of the invention.

Figure 1:
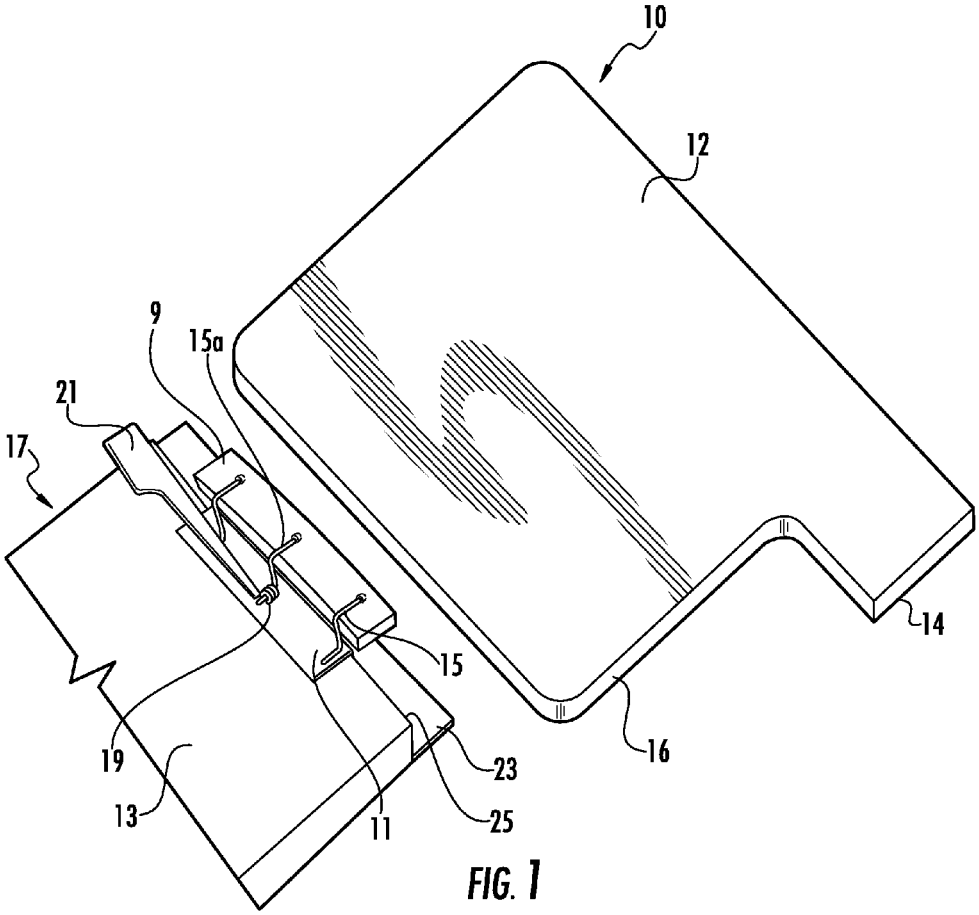
FIG. 1 is a top perspective view of a surface extender having spring action clamp according to an embodiment of the invention.

FIG. 1 shows a top perspective view of a school desktop according to an embodiment of the invention. As shown, desktop 10 comprises a top face 12 an underside surface 14 and sidewalls 16 which comprise the thickness of the desktop.

In one embodiment, a surface extender 17 is provided with a spring biased clamping device for gripping the side of a desk. As shown, a clamp arm 9 is movably connected to a mounting base 11 positioned on the top surface 13 of extender 17 by way of a plurality of bent arms 15. At least one of bent arms 15 (e.g. the center arm 15*a* shown in FIG. 1) terminates at mounting base 11 in a spring 19. A handle 21 is attached to the distal end of the spring 19. Handle 21 serves as the interface for lowering and raising clamp arm 9. When handle 21 is rotated in a first direction, arm 15*a* (and the other bent arms 15) pivots such that it moves downwardly—thereby lowering clamp arm 9. When handle 21 is rotated in a second direction, arms 15 pivot in a second direction to raise clamp arm 9.

When clamp arm 9 is lowered as described above it stops when it comes into contact with a surface to be gripped. However, because handle 21 extends from a spring 19, handle 21 may keep moving downward thus applying tension to the spring 19. Such tension translates to force being applied to clamp arm 9—and thus to the surface to be gripped (e.g. a desktop). As a result, the clamping device shown in FIG. 1 may be used to clamp and grip surfaces of varying thicknesses.

Still referring to FIG. 1, the extender is provided with a lower lip 23, which protrudes from its sidewall 25. Clamp arm 9 is positioned above and substantially parallel to lower lip 23. The space defined between lower lip 23 and clamp arm 9 is somewhat wider than the thickness of an average sized desktop.

In use, a user positions the extender 17 such that its lower lip 23 contacts the under surface of a desktop or similar surface. Handle 21 is then moved to lower clamp arm 9. The surface is thereby gripped between lower lip 23 and clamp arm 9. Alternatively, and as shown in FIG. 2, lower lip 23 could be placed on the top surface of the desktop—with the clamp being positioned on the underside thereof.

Figure 2:
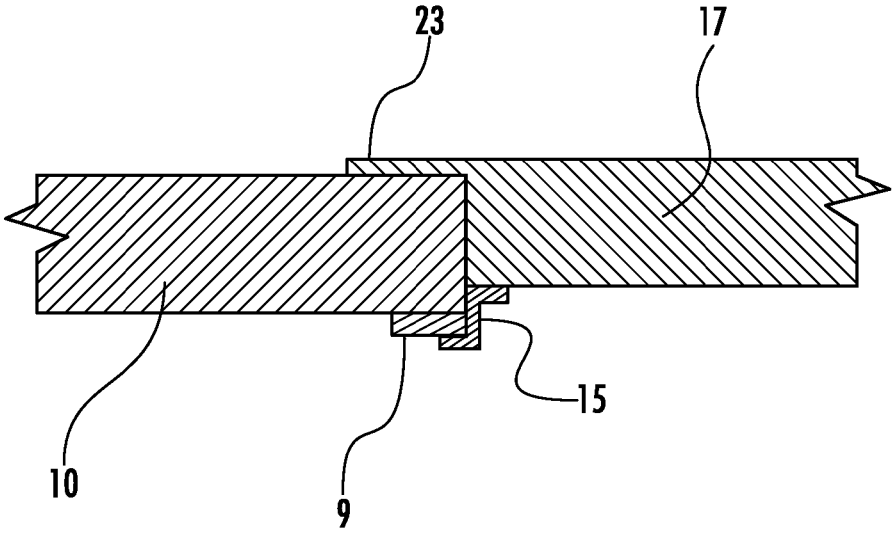
FIG. 2 is a side, cross-sectional view of the surface extender of FIG. 1 mounted to a desktop according to an embodiment of the invention.

FIG. 2 shows a cross-sectional view through an extender 17 as shown in FIG. 1 that is appended to a desktop 10—where lip 23 is oriented to contact the top face 12 of the desk, rather than the underside thereof.

In one preferred embodiment the surface extender comprises a slender piece of material, which has clamping or tensioning mechanisms affixed to its side surface and positioned to grip a side surface of a desk or table. For example, and as shown in FIG. 3, surface extender 18 is shown as being an essentially rectangular panel having a top surface 20, a bottom surface 22 and side walls 26, which comprise the thickness of the panel 18.

Figure 3:
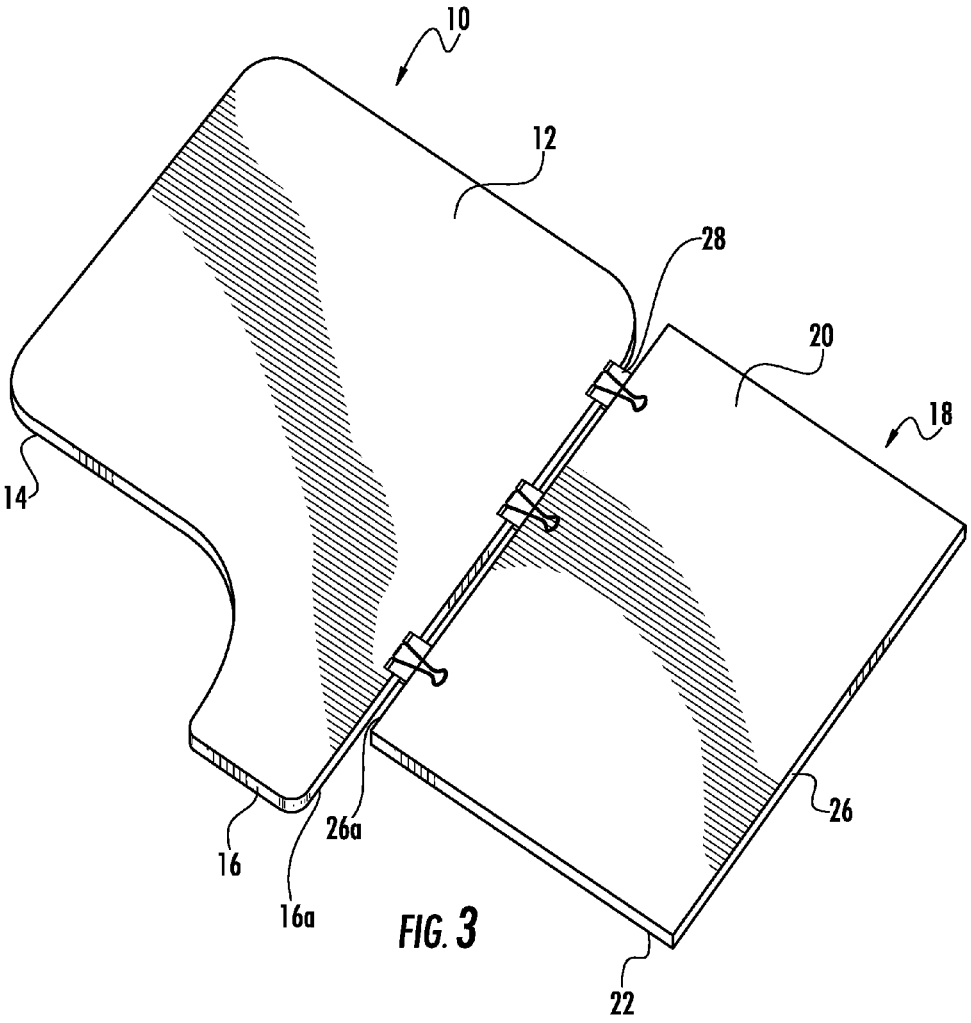
FIG. 3 is a top perspective view of a school desktop and a surface extender attached thereto according to an embodiment of the invention.

In one embodiment of the invention, one or more clasping or gripping members are affixed to inner sidewall 26*a* of extender 18 (note that "inner side wall" refers to the extender side wall which aligns with and faces the desktop sidewall when oriented as shown in FIG. 3). In one embodiment, and as shown in FIG. 3, the gripping members are binder clips 28.

Figure 4:
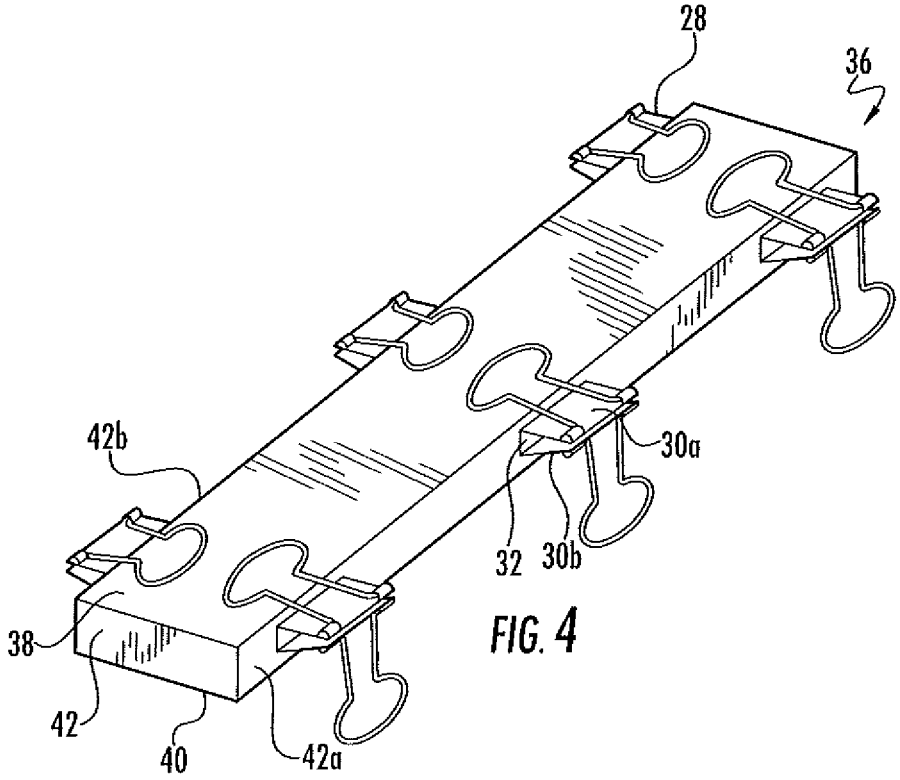
FIG. 4 is a top perspective view of a conjoining adaptor according to an embodiment of the invention.

In one embodiment of the invention, the binder clips are of the variety conventionally used for binding stacks of paper. Binder clips 28 are best shown in FIG. 4. Referring to FIG. 4, binder clips 28 are shown having two gripping arms 30*a*, 30*b*. The gripping arms 30*a*, 30*b* are joined by a backing 32 which bridges the gripping arms 30*a*, 30*b* together. As is well known in the art, the gripping arms angle downwardly as they extend from the backing and in the default position the distal tips of the gripping arms 30*a*, 30*b* contact one another. As such, when the distal tips are pulled apart they are biased toward the default (closed) position and accordingly they provide a strong grip on an object placed therebetween.

It will be understood by those of ordinary skill in the art that as an alternative to binder clips, any of various gripping members may be utilized in embodiments of the invention. For example, any of various tensioning clamps or other such similar devices used to join, grip or compress structural parts may be employed to grip a desk or similar surface in embodiments of the invention. Such devices are broadly referred to as "gripping members" herein. In some embodiments of the invention, a lip or such similar extension contacts a first side of a platform and a movable arm or contact member disposed substantially parallel to the lip contacts a second side of the platform—gripping the platform therebetween. Such movable arm or contact member also is referred to as a "gripping member" herein.

As shown in FIG. 3, a plurality of binder clips 28 is affixed to the inner sidewall 26*a* of extender 18. In use, a user separates the gripping arms 30*a*, 30*b* and places the open clip 28 on the edge of a surface. As shown in FIG. 3, a first gripping arm 30*a* contacts top face 12 of desk 10 and a second gripping arm 30*b* contacts the underside surface 14 thereof—thus, tightly gripping the desk edge.

The gripping members (either binder clips or other clamping devices) are affixed to the inner sidewall 26*a* of extender 18 by any of various attachment means. For example, gripping members may be affixed to extender via nails, screws, staples, glue or the like.

In one embodiment of the invention, when the extender 18 is mounted to a surface, its inner wall 26*a* is aligned with and in contact with the outer wall 16*a* of the surface to be extended ("outer wall" refers to the side wall of the edge to be extended—such as 16*a* in FIG. 1). This provides additional support and stability to the extender.

It will be understood by those of ordinary skill in the art that the inventive extender may be used to extend any various surfaces—including, for example, the outer edge of a table, desk, shelf or any of such similar platforms.

In one embodiment of the invention an extender 18 is affixed to a surface through the means of a conjoining adaptor, which is a temporary connector for rigidly joining surface edges. The conjoining adaptor serves as a bridge between a desk surface and an extender.

FIG. 4 shows a conjoining adaptor 36 according to an embodiment of the invention. As shown, conjoining adaptor 36 is a slender strip of material having a top face 38, an underside surface 40 and sidewalls 42, which are the thickness of the adaptor 36. One or more gripping members are provided on each of the sidewalls. For example, right sidewall 42*a* (i.e. the right side when oriented as shown in FIG. 4) is shown with three binder clips 28 affixed thereto. The binder clips are oriented such that their mouths point outwardly. Binder clips 28 are similarly affixed to opposite wall 42*b*.

Figure 5:
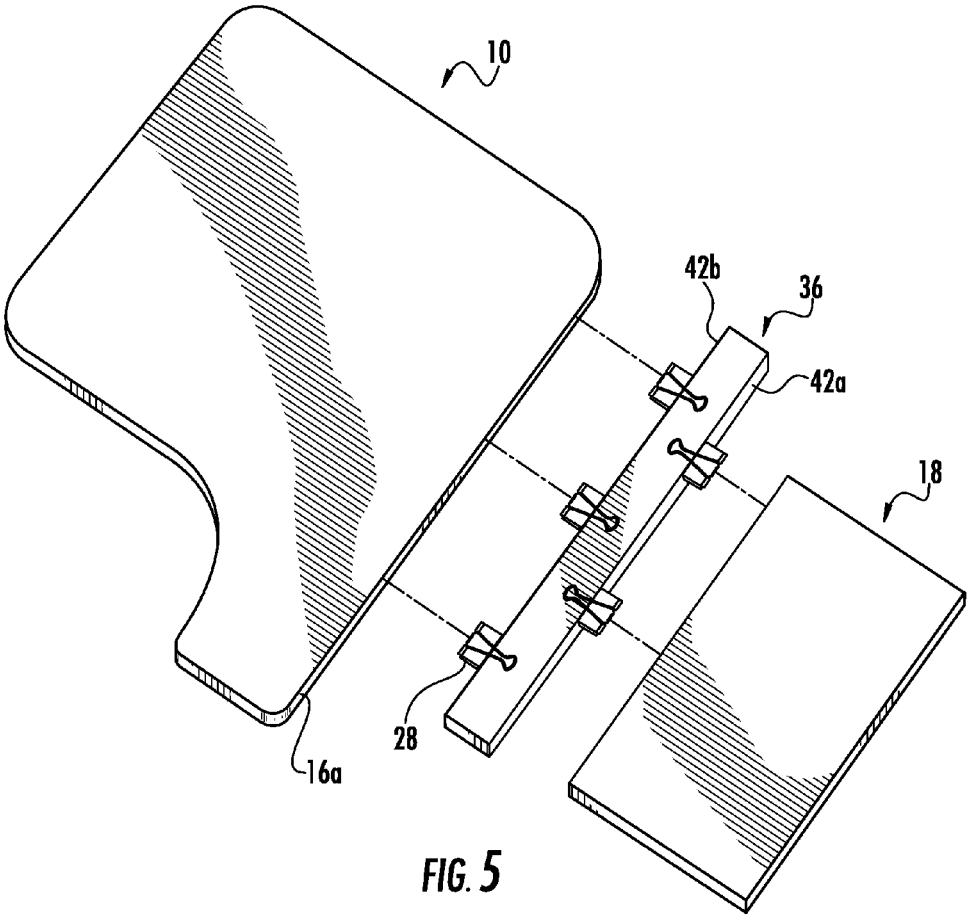
FIG. 5 is a top, perspective exploded view of a conjoining adapter aligned with a desktop and surface extender according to an embodiment of the invention.

FIG. 5 shows an exploded view of a conjoining adapter 36 positioned to attach to and thereby join a desktop 10 and a surface extender 18.

Figure 6:
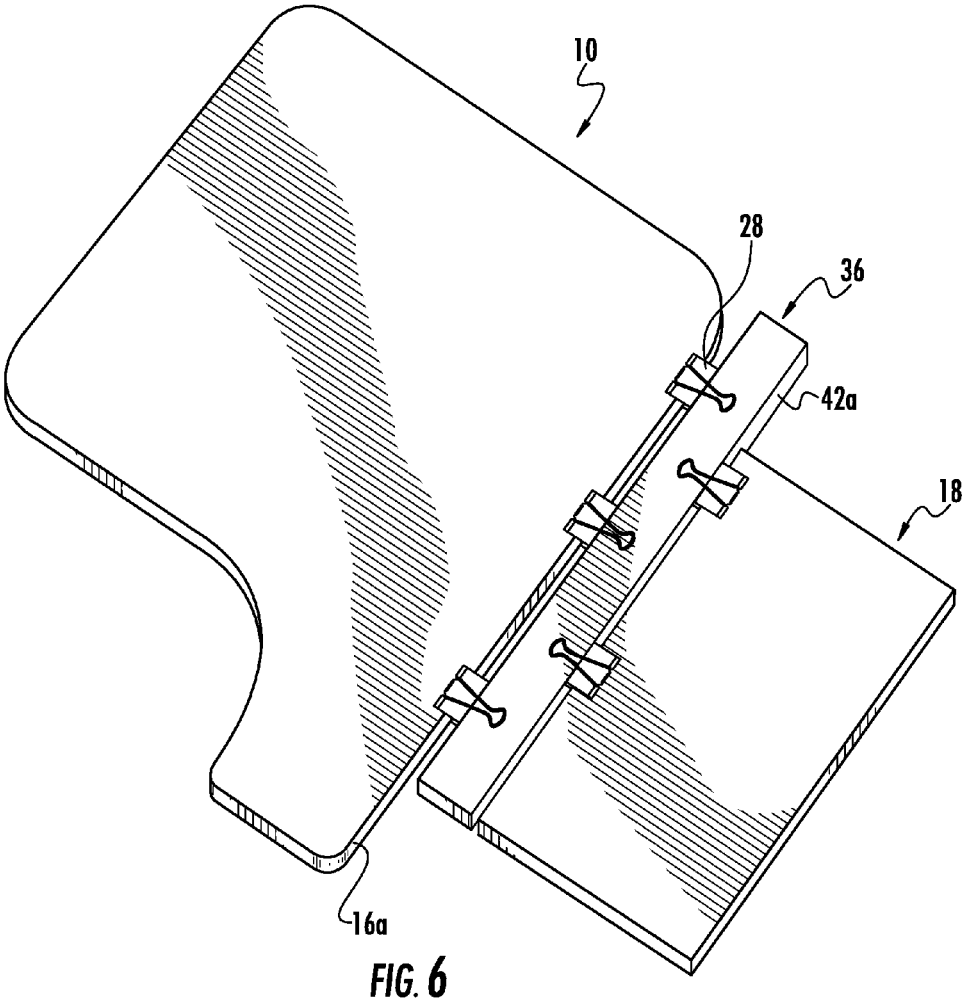
FIG. 6 is a top perspective view of the surface adaptor of FIG. 4 connecting a surface extender to a desktop according to an embodiment of the invention.

In use and as shown in FIG. 6, binder clips provided on sidewall 42*b* attach the adaptor 36 to a desk edge, whereas, binder clips 28 provided on sidewall 42*a* attach an extender surface 18. The methods and manner in which the adaptor is attached to the desk and to the extender surface is the same as described above with respect to the surface extender shown in FIG. 3. It will be understood by those of ordinary skill in the art that any of various gripping members may be appended to conjoining adapter 36 as an alternative to binder clips.

It will be understood by those of ordinary skill in the art that surface extender 18 may be of any variety of sizes, shapes and materials. In fact, when a conjoining adaptor 36 is utilized, users have the liberty to use any suitable panel or surface to attach to a desk. More specifically, when using a conjoining adaptor 36 as described herein, a user uses a first set of gripping members to attach the adaptor to a surface edge. A second set of gripping members projects outwardly to receive a surface extender. Users may choose to insert a hard plastic, cardboard or even a wooden surface.

In an embodiment of the invention, the portions of gripping members which contact the surface to be extended are provided with rubber, felt or such similar material to protect the surface and/or to enhance a frictional grip.

Figure 7:
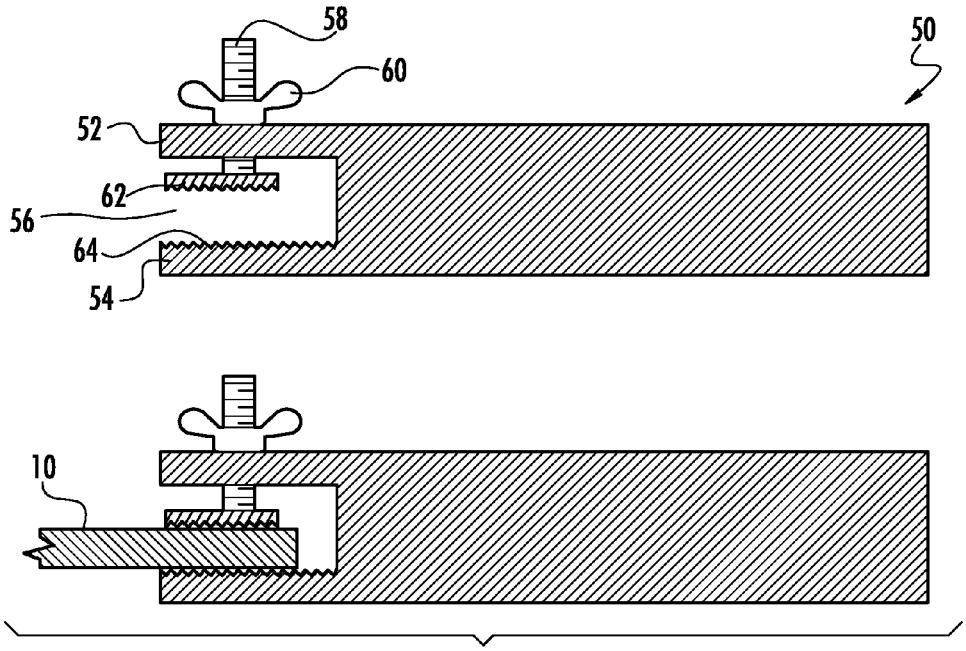
FIG. 7 is a side, cross-sectional view of a surface extender having a screw tightening mechanism according to an embodiment of the invention.

FIG. 7 shows a side view of a surface extender, which utilizes a tightening screw to grip a surface. As shown in FIG. 7, a surface extender 50 is a panel or plank having one side that is adapted to capture and grip a surface. The gripping side comprises an upper extension 52 and a lower extension 54—defining a space 56 situated therebetween. Space 56 is preferably slightly wider than the width of an average desktop—but various widths are contemplated in embodiments of the invention in order to capture any of various surface thicknesses.

Upper extension 52 (which is disposed substantially parallel to lower extension 54) is provided with a screw 58 which runs through a hole provided through the top thereof. A first end of the screw 58 extends from the outside surface of upper extension 58 and a second end of screw 58 terminates in a contact member 62. A wing 60 or such similar rotatable threaded member is provided around the shaft of screw 58 on the outside surface of upper extension 52. Rotation and counter rotation of wing 60, respectively, lowers and raises contacting member 62.

In use, a user inserts extender 50 on the side of a desktop 10 such that the desk thickness is in the space 56 defined by contact member 62 and lower extension 54. Wing 60 is then rotated to lower contact member 62 until it contacts a desk surface in a sufficiently tight grip. In an embodiment of the invention, contacting member 62 and lower extension 54 are provided with ridges 64 or such similar friction promoting elements to enhance the grip that is achieved.

Having described this invention with regard to specific embodiments, it is to be understood that the description is not meant as a limitation since further modifications and variations may be apparent or may suggest themselves to those skilled in the art. It is intended that the present application cover all such modifications and variation as fall within the scope of the appended claims.

What is claimed is:

1. A surface adaptor, comprising:

a piece of material comprising a top face, an underside surface, a first substantially straight sidewall and a second substantially straight sidewall;

said first sidewall comprising one or more gripping members facing a first direction, said second sidewall comprising one or more gripping members facing a second direction, said second direction being substantially opposite of said direction of said first one or more gripping members, said one or more gripping members facing said first direction comprises a movable arm, said movable arm biased to a closed position, said gripping member said second direction comprises a movable arm, said movable arm biased to a closed position, whereby said one or more gripping members on said first sidewall are adapted to grip an edge of a surface to be extended and said one or more gripping members on said second sidewall are adapted to grip a surface extender comprising a panel.

2. The surface adaptor of claim 1, whereby said one or more gripping members is a spring biased clamp.

* * * * *